US007630793B2

(12) United States Patent
Thomas et al.

(10) Patent No.: US 7,630,793 B2
(45) Date of Patent: Dec. 8, 2009

(54) METHOD OF ALTERING OPERATION OF WORK MACHINE BASED ON WORK TOOL PERFORMANCE FOOTPRINT TO MAINTAIN DESIRED RELATIONSHIP BETWEEN OPERATIONAL CHARACTERISTICS OF WORK TOOL AND WORK MACHINE

(75) Inventors: Dante Toran Thomas, Garner, NC (US); Mark Andrew Sporer, Apex, NC (US); Kevin Edward Pielmeier, Cary, NC (US); Joseph Dale Groves, Apex, NC (US)

(73) Assignee: Caterpillar S.A.R.L., Geneva (CH)

( * ) Notice: Subject to any disclaimer, the term of this patent is extended or adjusted under 35 U.S.C. 154(b) by 767 days.

(21) Appl. No.: 11/008,104

(22) Filed: Dec. 10, 2004

(65) Prior Publication Data

US 2006/0129280 A1 Jun. 15, 2006

(51) Int. Cl.
*G05B 13/00* (2006.01)
*G06F 19/00* (2006.01)

(52) U.S. Cl. ..... 700/275; 701/50

(58) Field of Classification Search ..... 701/50; 700/275

See application file for complete search history.

(56) References Cited

U.S. PATENT DOCUMENTS 4,117,899 A 10/1978 Sagaser et al.
4,277,898 A * 7/1981 Flippin ..... 37/348
4,423,785 A 1/1984 Kurihara et al.
4,518,044 A * 5/1985 Wiegardt et al. ..... 172/7
5,590,731 A 1/1997 Jacobson
5,737,993 A 4/1998 Cobo et al.
5,860,480 A 1/1999 Jayaraman et al.
5,941,921 A 8/1999 Dasys et al.
5,953,977 A 9/1999 Krishna et al.
6,029,445 A 2/2000 Lech
6,061,617 A 5/2000 Berger et al.
6,076,030 A 6/2000 Rowe
6,167,336 A 12/2000 Singh et al.
6,354,081 B1 3/2002 Burton
6,467,264 B1 10/2002 Stephenson et al.
6,542,789 B2 * 4/2003 Ufheil ..... 700/275
6,615,114 B1 9/2003 Skiba et al.
7,539,570 B2 * 5/2009 Normann ..... 701/50
2003/0051470 A1 3/2003 Maddock
2004/0060205 A1 4/2004 Yoshino
2004/0117092 A1 6/2004 Budde

* cited by examiner

*Primary Examiner*—Ryan A Jarrett
(74) *Attorney, Agent, or Firm*—Finnegan, Henderson, Farabow, Garrett & Dunner

(57) ABSTRACT

A method of operating a work machine includes sensing at least one operational characteristic of a work tool indicative of current work tool performance. The method also includes altering the operation of the work machine in response to the sensing to maintain a desired relationship between the at least one operational characteristic of the work tool and at least one operational characteristic of the work machine.

14 Claims, 3 Drawing Sheets

METHOD OF ALTERING OPERATION OF WORK MACHINE BASED ON WORK TOOL PERFORMANCE FOOTPRINT TO MAINTAIN DESIRED RELATIONSHIP BETWEEN OPERATIONAL CHARACTERISTICS OF WORK TOOL AND WORK MACHINE

TECHNICAL FIELD

This disclosure relates generally to a system and method for controlling a work machine, and more particularly, to a system and method for altering the operation of the work machine based on sensed work tool operational characteristics.

BACKGROUND

Conventional work machines can be used in many different applications, including those in the areas of construction, agriculture, landscaping, and mining. To perform these applications, work tools are typically mounted to work machine lift arms or other articulated members, and may connect to one or more of the work machine's hydraulic mechanisms.

A work machine operator may drive the work machine, and control any work tools attached thereto, through the use of various operator interfaces. These operator interfaces may control hydraulic fluid flows and pressures, and may thereby control the operation of the attached work tool during performance of the application. For example, work machines may include one or more hydraulic circuits used in actuating various work tool lift and tilt mechanisms on the work machine. In the case of some work tools, an auxiliary hydraulic circuit may be used to supply hydraulic fluid to the work tool for operating various mechanisms located on the work tool.

The demands placed on the auxiliary hydraulic circuit may vary based on a number of factors including, for example, the type and/or manufacturer of the work tool attachment, and the task it is being used to perform. In addition, each particular work tool may have a range of speeds, pressures, flows, or other operational characteristics within which the tool is designed to operate. Operating the work tool within these ranges or design parameters may improve the performance of the work tool. The various design parameters of a given work tool may be within, but different than, the operational tolerances or maximum allowable speeds, pressures, and flows of the work tool and/or work machine. Thus, to improve the performance of a work machine/work tool system it may be necessary to sense the work tool's operational characteristics as it performs a task and alter the work machine's operation such that the work tool functions within the work tool's design parameters.

Current work machine control systems may alter a work machine's operation based on the maximum operational tolerances of the work tool, instead of altering the operation of the work machine based on the work tool's design parameters. For example, U.S. Patent Application Publication No. US 2003/0051470 A1 ("the '470 publication") discloses a system for controlling hydraulic work tools. The system includes a work machine, a controller computer, and a work tool attached to the work machine. The work tool includes a storage chip, and may include a sensor that collects continual operational information and transmits it to the controller computer. According to the '470 publication, the storage chip on the work tool transmits a signal to the controller computer indicating the maximum operating fluid pressure and maximum operating fluid velocity of the corresponding work tool. The controller computer considers this information to prevent exceeding these operational tolerances of the work tool when calculating the fluid flow rates and pressures required to accomplish a desired application.

Controlling a work machine based on the operational tolerances or limits of a particular work tool may prevent damage to the work tool, but may not improve the performance of the work machine/work tool system for a given application. For example, these tolerances may be unrelated to, and may be significantly higher than, the fluid flow rates or fluid pressures with which the work tool was designed to operate efficiently. In such a situation, a tolerance-based control strategy may control the work machine to perform up to the operational limits of the work tool before affecting a change in the operation of the work machine. As a result, the work tool may be controlled to perform beyond its design parameters and the overall performance of the work machine may be hindered.

The present disclosure provides a work machine control system that avoids some or all of the aforesaid shortcomings in the prior art.

SUMMARY OF THE INVENTION

In accordance with one aspect of the present disclosure, a method of operating a work machine includes sensing at least one operational characteristic of a work tool indicative of current work tool performance. The method also includes altering the operation of the work machine in response to the sensing to maintain a desired relationship between the at least one operational characteristic of the work tool and at least one operational characteristic of the work machine.

In accordance with another aspect of the present disclosure, a method of operating a work machine includes sensing at least one of work tool fluid pressure, work tool speed, or work tool fluid flow. The method also includes modifying work machine ground speed in response to the sensing to maintain a desired ratio between the work machine ground speed and at least one of work tool fluid pressure, work tool speed, or work tool fluid flow.

In accordance with yet another aspect of the present disclosure, a method of operating a work machine includes sensing at least one of work tool fluid pressure, work tool speed, or work tool fluid flow. The method also includes modifying a flow of fluid from the work machine to the work tool in response to the sensing to maintain a desired ratio between the flow of fluid from the work machine and at least one of work tool fluid pressure, work tool speed, or work tool fluid flow.

In accordance with still another aspect of the present disclosure, a work machine operating system includes a plurality of sensors configured to sense at least one operational characteristic of a work tool and at least one operator interface. The system also includes a controller configured to maintain a desired relationship between the at least one operational characteristic of the work tool and at least one operational characteristic of the work machine.

DETAILED DESCRIPTION

Reference will now be made in detail to the drawings. Whenever possible, the same reference numbers will be used throughout the drawings to refer to the same or like parts.

Figure 1:
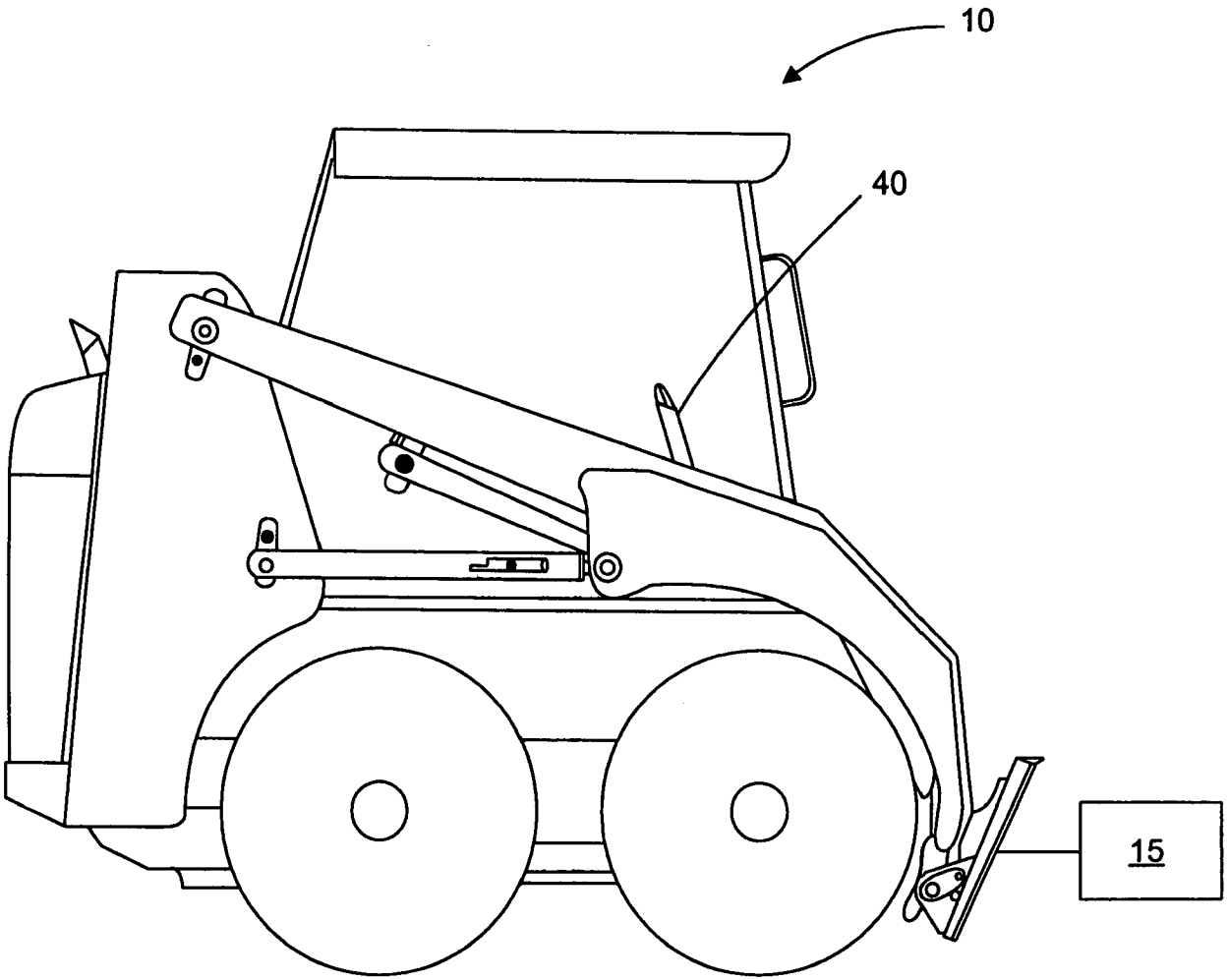
FIG. 1 is a partial side view and a partial diagrammatic view of a work machine according to an exemplary embodiment of the present disclosure.

FIG. 1 illustrates a work machine 10 according to an exemplary embodiment of the present disclosure. Although FIG. 1 depicts a skid steer loader machine, it is understood that aspects of the present disclosure may be used in conjunction with any other work machine 10 known in the art. Such work machines 10 may include, but are not limited to, wheel dozers, wheel loaders, track loaders, backhoe loaders, compactors, forest machines, front shovels, hydraulic excavators, integrated tool carriers, multi-terrain loaders, material handlers, and agricultural tractors.

Work machine 10 may include one or more operator interfaces 40. As illustrated in FIG. 1, operator interfaces 40 are typically located in the operator compartment of the work machine 10, but can be located elsewhere. Such operator interfaces 40 may include, but are not limited to, levers, switches, buttons, foot pedals, joysticks, control wheels, touchpads, touch screen displays, LCD displays, computer screens, and keyboards. The operator interfaces 40 may be operatively connected to the work machine 10 to facilitate either work machine control, work tool control, or both. The operator interfaces 40 may also facilitate communication between the operator and a control unit (not shown).

As illustrated in FIG. 1, a work tool 15 may by operatively attached to the front end of the work machine 10. It is understood that if a work machine 10 is capable of utilizing rear-mounted work tools 15, such tools 15 may also be operatively attached to the back-end of the work machine 10. It is further understood that work tools 15 may be operatively attached to the side, top, bottom, or other locations on the work machine 10 and that such tools 15 may be controlled by the methods disclosed herein.

Work tools 15 may be divided into a number of different categories. For instance, work tools 15 may be described as either being capable of performing a single application, or being capable of performing more than one. Such "single-application" work tools 15 may include, but are not limited to, trenching tools, material handling arms, augers, brooms, rakes, stump grinders, snow blowers, wheel saws, de-limbers, tire loaders, and asphalt cutters. Likewise, "multi-application" work tools, may include, but are not limited to, buckets, angle blades, cold planers, compactors, forks, landscape rakes, grapples, backhoes, hoppers, multi-processors, truss booms, and thumbs. In the exemplary embodiment shown in FIG. 1, the work tool 15 attached to the work machine 10 may be either a single-application or a multi-application work tool 15.

Work tools 15 may also be categorized according to whether or not they utilize hydraulic fluid to perform a desired task. Such "hydraulic" work tools 15 may include, for example, material handling arms, augers, brooms, stump grinders, wheel saws, snow blowers, asphalt cutters, compactors, grapples, and multi-processors. On the other hand, "non-hydraulic" work tools may include, for example, trenching tools, rakes, de-limbers, tire loaders, buckets, angle blades, cold planers, forks, landscape rakes, backhoes, hoppers, and truss booms. While non-hydraulic work tools may not utilize pressurized hydraulic fluid to perform tasks, some non-hydraulic work tools may utilize other on-tool control means such as, for example, electric motors, pneumatics, and/or solenoids to assist in performing various applications. Aspects of the present disclosure may be used with any of the aforementioned work tools 15, as well as those not mentioned herein, regardless of how the work tool 15 is categorized or how the work tool 15 functions.

In addition, aspects of the present disclosure may be used regardless of the application being performed by work tool 15. Such applications may include, for example, grinding, stockpiling, trenching, hammering, digging, raking, grading, moving pallets, material handling, snow removal, tilling soil, demolition work, carrying, cutting, backfilling, and sweeping.

Figure 2:
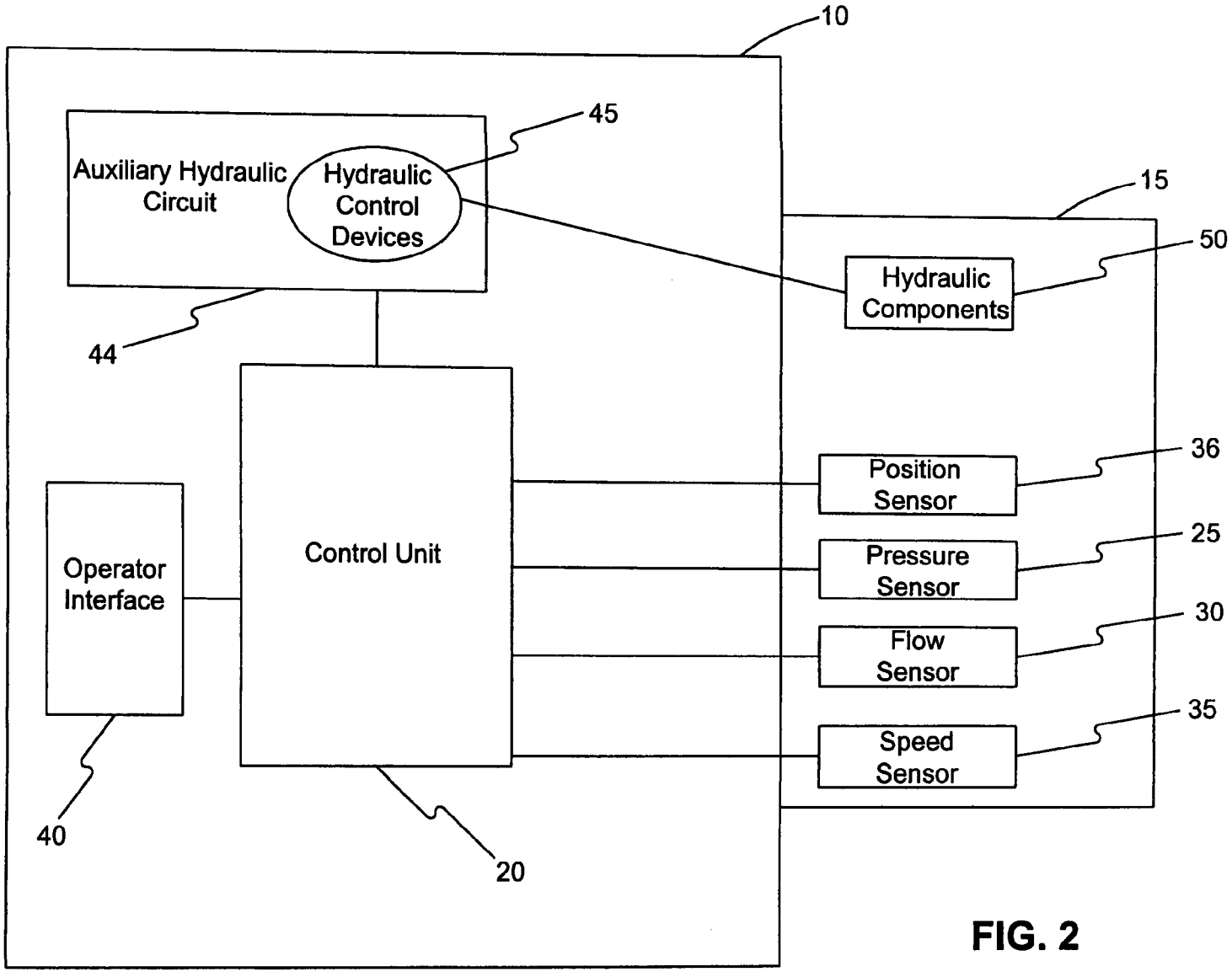
FIG. 2 illustrates a block diagram representation of a work machine control system in accordance with an exemplary embodiment of the present disclosure.

FIG. 2 schematically illustrates a control system for a work machine 10 with a work tool 15 operatively attached in accordance with an exemplary embodiment of the present disclosure. As illustrated in FIG. 2, a work machine 10 may include a control unit 20. It is understood that the control unit 20 may be, for example, an electronic control module ("ECM"), a system computer, a central processing unit, or other data storage and manipulation device known in the art. The control unit 20 may be located anywhere on the work machine 10 and may be in communication with the operator interfaces 40 described above. The control unit 20 may also be in communication with, for example, work tool pressure, flow, speed, and position sensors 25, 30, 35, 36 respectively, and at least one hydraulic control device 45 such as, for example, a work tool hydraulic flow valve (each of these items will be described in greater detail below).

The control unit 20 may be capable of storing data, and may have internal memory devices that enable the storage of data. Such devices may include, for example, a hard drive, a floppy disc drive, a cd-rom drive, or other data storage devices known in the art. The data stored may correspond to known applications and work tools 15, and the control unit 20 may be capable of updating this and other data with new data. It is understood that in all embodiments of the present disclosure, the control unit 20 may store information corresponding to ranges of speed, pressure, flow, and/or other operational characteristics for a plurality of work tools 15. This information may be specific to each work tool 15, and may define ranges or design parameters within which the work tool 15 may be designed to operate. Operating a work tool 15 within these ranges or design parameters may improve the performance of the work tool 15 during a given application and may also improve the overall performance of the work machine 10 during the application.

The control unit 20 may also be capable of processing data, and may have internal data processing devices to enable the processing of data. Such devices may include, for example, a microprocessor of a type and speed known in the art. The control unit 20 may be capable of receiving inputs from, and sending outputs to, as many work machine elements and work tool sensors as is necessary to accomplish the different control strategies of the present disclosure. These work machine elements and work tool sensors may be in addition to the elements and sensors mentioned above. For example, the work machine 10 may include a plurality of operator interfaces 40, and the work tool 15 may include more than one pressure, flow, speed, and position sensor 25, 30, 35, 36.

The control unit 20 may be, for example, a Delphi A1-2C or a Delphi A4-M1 controller manufactured by Delphi Corporation of Troy, Mich., U.S.A. The control unit 20 may be rigidly attached to a structure of the work machine 10 or the work tool 15 by any means known in the art, and may be dampened to minimize the effect of vibrations, collisions, and other sudden, jarring, or repeated motions. Such control units 20 may control the drive functions of the work tool 15. These functions may include, for example, starting, accelerating, decelerating, stopping, and rotating the work tool 15. In some embodiments, the control unit 20 may be in communication with any number of additional controllers (not shown) located either on the work tool 15 or the work machine 10. In such embodiments, the control unit 20 may communicate with the additional controllers through a control area network or other communication means known in the art.

Referring still to FIG. 2, in addition to the pressure sensor 25, flow sensor 30, speed sensor 35, and position sensors 36, optical sensors, audio sensors, or other sensors or mechanisms known in the art may be coupled to the control unit 20. Each of the sensors may be connected to an element of the work tool 15, the sensing of which may be useful in determining the amount of, for example, effort, force, or energy required to perform a desired task.

The location of a particular sensor on the work tool 15 may correspond to the operational characteristic of the work tool 15 being measured. For example, in an embodiment of the present disclosure, the pressure sensors 25 may be hydraulic fluid pressure sensors located on one or more hydraulic cylinders of the work tool 15, and may measure the pressure of the hydraulic fluid within the cylinders. The flow sensors 30 may be hydraulic fluid flow sensors fluidly connected to hydraulic elements of the work tool 15, or to an auxiliary hydraulic circuit 44 of the work machine 10, and may measure the flow of hydraulic fluid from the work machine 10 to the work tool 15. In embodiments where the work tool 15 has multiple hydraulic components, the work tool 15 may include a plurality of flow sensors 30. Each sensor 30 may be configured to sense a flow of hydraulic fluid from the work machine 10 to a corresponding hydraulic component of the work tool 15. The speed sensors 35 may be work tool speed sensors such as, for example, wheel type speed sensors located on one or more moving elements of the work tool 15, and may measure the speed with which the elements rotate, turn, or otherwise move with respect to a stationary reference.

The position sensors 36 may be work tool position sensors located on any moving part of the work tool 15. The position sensors 36 may sense the position of the different parts of the work tool 15 relative to each other. The position sensors 36 may also sense the position of the work tool 15 with respect to a reference point. It is understood that the position sensors 36 may be configured to sense the angle, height, depth, and/or other positions of the work tool 15 or its parts relative to the reference point. The reference point may be a fixed point on or off of the work machine 10. The reference point may also move relative to the work machine 10. For example, in an embodiment, the reference point may be located on another moving work machine 10. In another embodiment, the position sensors 36 may have global positioning capabilities. In still another embodiment, the reference point may include a point or other location on the ground or other surface supporting the work machine 10.

It is understood that additional sensors (not shown) may be located on the work machine 10 and may be positioned to sense work machine 10 operational characteristics of the type described above. Such work machine sensors may also be in communication with the control unit 20. Operational characteristics of the work machine 10 may include, for example, the ground speed of the work machine 10 and the flow of hydraulic fluid from the auxiliary hydraulic circuit 44 of the work machine 10 to the work tool 15. The ground speed of the work machine 10 may be the work machine's speed of travel across a work terrain. The ground speed of a work machine 10 may be operator controlled or may be automatically controlled through a control strategy. When ground speed is automatically controlled, the work machine 10 may include hydro-mechanical components (not shown) electrically connected to the control unit 20 and configured to control ground speed. It is understood that the ground speed of the work machine 10 may be substantially directly related to the load applied to the work tool 15 when the work tool 15 acts on a substantially uniform material.

According to one exemplary embodiment, the control unit 20 may be a means for maintaining a desired relationship or ratio between at least one operational characteristic of the work tool 15 and at least one operational characteristic of the work machine 10. For example, in applications where the sensors 25, 30, 35, 36 sense at least one of an increase in work tool fluid pressure, a decrease in work tool fluid flow, a decrease in work tool speed, or a change in work tool position, the control unit 20 may control aspects of the work machine 10 so as to decrease the ground speed of the work machine 10, and/or increase the flow of fluid from the work machine 10 to the work tool 15. Such conditions may result from the work tool 15 seizing, being bound up, or otherwise experiencing an increased load. In such an increased load condition, the decrease in work tool fluid flow may be the result of the increase in work tool fluid pressure, and may not occur due to the operation of a valve or other flow control device. Thus, when load on the work tool 15 increases, work tool fluid flow and work tool fluid pressure may be inversely related.

On the other hand, in applications where the sensors 25, 30, 35, 36 sense at least one of a decrease in work tool fluid pressure, an increase in work tool fluid flow, an increase in work tool speed, or a change in work tool position, the control unit 20 may control aspects of the work machine 10 so as to increase the ground speed of the work machine 10 and/or decrease the flow of fluid from the work machine 10 to the work tool 15. Such conditions may result from the work tool 15 suddenly acting on a relatively low-density material or otherwise experiencing a decrease in load. In such a decreased load condition, the increase in work tool fluid flow may be the result of the decrease in work tool fluid pressure, and may not occur due to the operation of a valve or other flow control device. Thus, when load on the work tool 15 decreases, work tool fluid flow and work tool fluid pressure may be inversely related.

Controlling aspects of the work machine 10 as explained above causes the work tool 15 to operate within a desired performance range or design parameter that is less than an operational tolerance of the work tool. These desired relationships between the operational characteristics of the work tool 15 and the operational characteristics of the work machine 10 may be substantially direct or indirect. It is understood that the desired relationships or ratios may be based on the application being performed, and may correspond to the desired performance range or design parameter of the work tool 15. As a result, the work machine 10 may be controlled in order to maximize work tool efficiency.

It is also understood that in order to operate the work tool 15 within its desired performance range, the work machine 10 may not be operated within its desired performance range in some applications. For example, operating a given work tool 15 within its desired performance range may require operating the work machine 10 to which it is attached at a ground speed of 5 feet per minute. The desired performance range of the particular work machine 10, however, may be approximately 50-60 feet per minute. Thus, operating the work tool 15 within its desired performance range would result in operating the work machine 10 outside of its desired performance range. In some situations, however, operating the work tool 15 within its desired performance range, rather than the work machine 10, may result in optimum performance of the application and may, thus, be preferred.

Although not shown in FIG. 2, the work machine 10 may include at least one primary hydraulic circuit. The primary hydraulic circuit may include, for example, hydraulic cylinders, hydraulic flow valves, hydraulic fluid hoses, fittings, hydraulic fluid pumps, and other structures useful in controlling the flow of hydraulic fluid. These structures may form a closed loop fluid circuit on the work machine 10 and may be utilized in conjunction with other components of the work machine 10 to control various aspects of the work machine's operation. For example, an end of a hydraulic cylinder of the primary hydraulic circuit may be attached to an articulating arm of the work machine 10, while another end may be attached to the body of the work machine 10. The hydraulic cylinder may thus be configured to actuate the articulating arm in response to a command from, for example, the control unit 20. Actuating the articulating arm may assist in adjusting the position of a work tool 15 attached thereto with respect to a reference point.

In an embodiment of the present disclosure the position of the work tool 15 may be controlled throughout an entire range of motion as a desired application is performed. In such an embodiment, the control unit 20 may control the work machine 10 to perform an application requiring the dynamic control of the work tool 15. For example, the control unit 20 may be programmed to control the trimming of a bush using a trimming work tool 15 attached to a work machine 10. In such an embodiment, the control unit 20 may control the position and/or movement of the tool 15 through a predetermined range of motion corresponding to a desired bush shape. The position and/or motion control may be with respect to a reference point at, for example, the base of the bush being trimmed. The position and/or motion of the tool 15 may be controlled even as the work machine 10 moves with respect to the reference point.

The auxiliary hydraulic circuit 44 of the work machine 10 may contain devices similar to those discussed with respect to the primary hydraulic circuit. The auxiliary circuit 44, however, may be configured to supply hydraulic fluid to hydraulic components 50 of the work tool 15 rather than to the work machine 10. For example, as described above, a work tool 15 may include one or more hydraulic components 50 useful in performing a desired task. The hydraulic components 50 may be, for example, hydraulic cylinders. When connected to the work machine 10, and more particularly, to the auxiliary circuit 44 of the work machine 10, the hydraulic components 50 of the work tool 15 may receive hydraulic fluid from the auxiliary hydraulic circuit 44 in a controlled manner. Thus, the auxiliary hydraulic circuit 44 may assist in adjusting the position of at least an aspect of the work tool 15 with respect to a reference point located on or off the work machine 10.

As illustrated in FIG. 2, the flow of hydraulic fluid from the auxiliary circuit 44 to the work tool 15 may be controlled by hydraulic flow control devices 45 on the work machine 10. These control devices 45 may include, for example, electric controls, hydraulic controls, pneumatic controls, hydraulic control valves, or other devices capable of controlling or manipulating the flow of hydraulic fluid. The control devices 45 may be in communication with the control unit 20, and may be of a type, brand, and model known in the art. The control devices 45 may be connected to the auxiliary hydraulic circuit 44 by any conventional means, and may be an integral part of the circuit 44.

Figure 3:
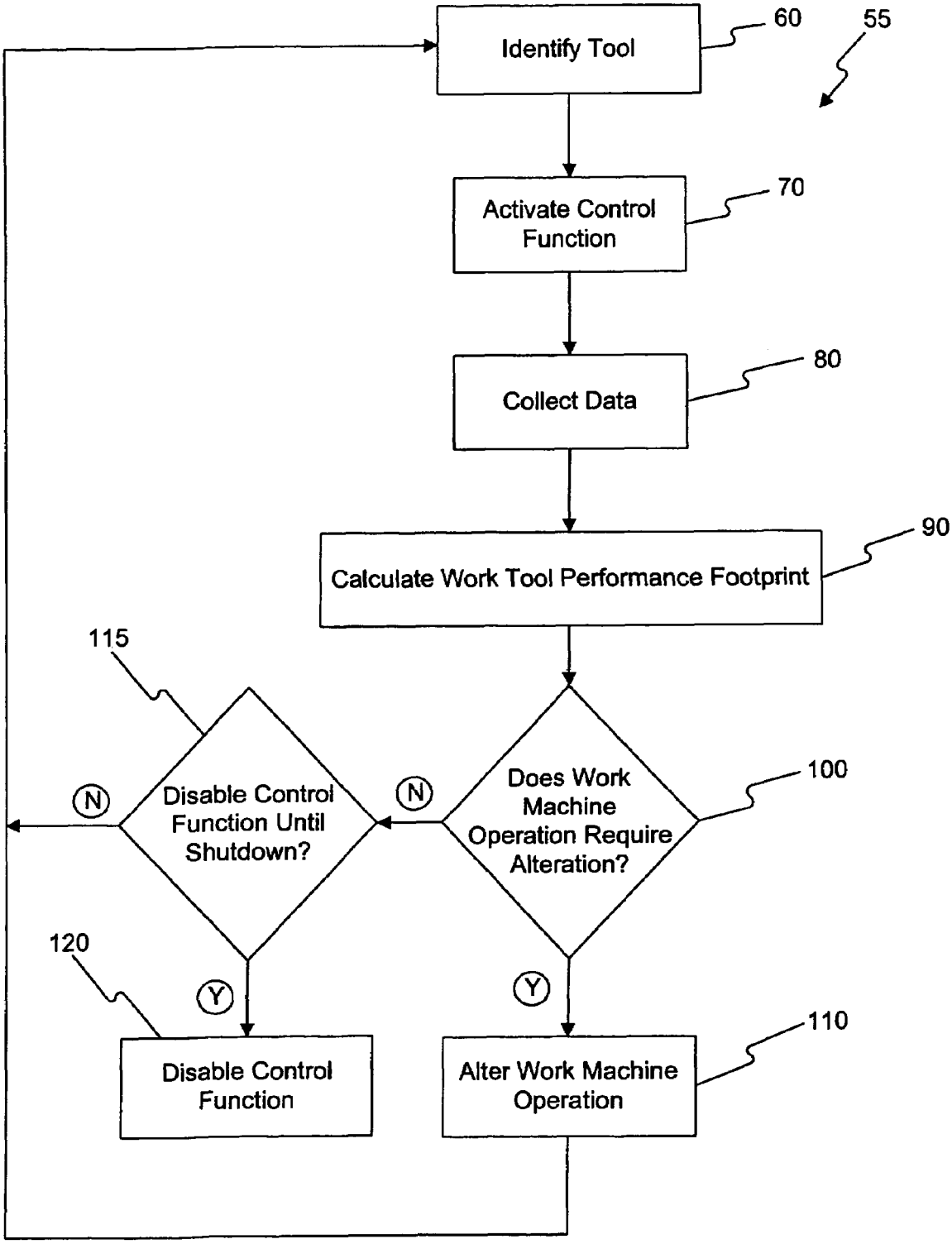
FIG. 3 is a flow chart of a work machine control strategy corresponding to an exemplary embodiment of the present disclosure.

FIG. 3 illustrates a work machine control strategy 55 according to an exemplary embodiment of the present disclosure. The strategy 55 may be facilitated by the control unit 20, and may be used to alter the operation of a work machine 10 in response to, for example, sensed operational characteristics of the work tool 15 and/or a current application of the work machine 10. The operation of the work machine 10 may also be altered in response to the sensing of the operational characteristics based on at least one desired performance range or design parameter of the work tool 15. As will be described in greater detail later, altering a work machine's 10 performance or operation may include changing parameters such as, but not limited to, ground speed, hydraulic cylinder priority, cylinder pressure, cylinder position, and hydraulic fluid flow from the auxiliary hydraulic circuit 44 of the work machine 10 to the work tool 15. For example, in some embodiments of the present disclosure the work machine 10 may alter the proportion of hydraulic fluid sent to one or more hydraulic components of the work tool 15. In further embodiments, the work machine's operation may be altered automatically.

The process of altering a work machine's 10 performance may begin by identifying a work tool 15 (Box 60). The work tool 15 may be identified by the operator, before or after it is physically attached to the work machine 10, in any number of ways. For example, in one embodiment of the present disclosure, service interface software may be operatively installed on a laptop computer (not shown), service connector, or other device known in the art. The service interface software may facilitate communication between the laptop and the control unit 20, and may convert operator input into work tool identification data that is transferred to the control unit 20. In another embodiment of the present disclosure, the work tool 15 may be identified by, for example, scanning a barcode located on the work tool 15, or through any wireless communication means known in the art.

In still another embodiment, the operator may input tool identification data to the control unit 20 directly using any of the operator interfaces 40 discussed above. In embodiments of the present disclosure, the control unit 20 may store the tool identification data in conjunction with, for example, the number of hours the particular tool 15 was used with the work machine 10. Tool identification data and usage information may be retrieved and downloaded from the control unit 20 to, for example, a computer terminal or laptop computer for analysis.

Work tool identification data may include, for example, type, model number, serial number, manufacturer, or other data useful in identifying the work tool 15 either generically or specifically. The work tool identification data may correspond to and identify work tools 15 regardless of the work tool manufacturer. The work tool identification data may also correspond to preset maps stored in the memory of the control unit 20. Thus, once the work tool 15 has been identified by the operator, the control unit 20 may automatically select one or more preset maps corresponding to the identified work tool 15. The preset maps may contain one or more algorithms corresponding to various applications capable of being performed by the identified work tool 15. As will be described in greater detail below, the control unit 20 may use these algorithms to calculate work tool performance footprints. The control unit 20 may compare calculated work tool performance footprints to work tool-specific design parameters in determining whether to alter the operation of the work machine 10.

The next Box in the process of altering a work machine's operation includes activating a work machine control function (Box 70). This Box may be achieved in any number of ways known in the art. For example, an operator may activate the control function by actuating one of the operator interfaces 40 mentioned above, thereby sending an activation signal to the control unit 20. Alternatively, the function may be activated automatically by the control unit 20. This automatic activation may correspond to a specified time during the work cycle, an occurrence of a specified event, or work machine 10 start-up.

Upon receiving the activation signal, the control unit 20 may begin to collect data (Box 80). This data may be, for example, pressure, flow, speed, or position data, or other operational characteristic data of the work tool 15 or work machine 10. The control unit 15 may collect data from, for example, the sensors 25, 30, 35, 36 (FIG. 2) and operator interfaces 40 (FIG. 2) described above.

In one embodiment of the present disclosure, the work machine control strategy 55 may be a closed loop strategy. The sensors 25, 30, 35, 36 and operator interfaces 40 may be in operation from work machine 10 start-up to work machine 10 shut-down, and may continuously send data to the control unit 20 regardless of whether the closed loop control function has been activated. The control unit 20 may only collect and use this data, however, after the closed loop control function has been activated.

The control unit 20 may calculate at least one work tool performance footprint using the data (Box 90). In making this calculation, the control unit 20 may input the data into one or more preset algorithms useful in determining how to alter the operation of the work machine 10 to improve performance. The algorithms used may vary for each different work tool 15. The algorithms used may also correspond to preset maps selected for use by the control unit 20 based on the work tool 15 identified, and the data collected, by the control unit 20.

For example, the control unit 20 may determine that an asphalt cutter is connected to a work machine 10 through the processes described above. After identifying the asphalt cutter, the control unit 20 may identify a group of preset maps stored in its memory that correspond to the identified asphalt cutter. The control unit 20 may then collect data during a number of work cycles. Based on the data collected, the control unit 20 may select a particular preset map from among the group of corresponding preset maps.

The selected preset map may be the preset map most closely correlated to the data collected. The preset map selected, and the data collected from the asphalt cutter, may also correspond to the particular application being performed by the asphalt cutter. Both the preset map and the data collected may vary from application to application. For instance, the control unit 20 may select a first preset map based on data collected when the asphalt cutter is used to cut relatively new or dense pieces of asphalt, but may select a second preset map when the same asphalt cutter is used to cut weathered or fragmented pieces. Each preset map may contain algorithms specific to the range of data collected and/or the application being performed. It is understood that each different preset map may contain different algorithms for calculating work tool performance footprints.

Once the work tool performance footprint has been calculated, the control unit 20 may compare the calculated work tool performance footprint to the design parameter information of the particular work tool 15 attached to determine whether the work machine's 10 operation requires alteration (Box 100). If the footprint is within the desired performance range or design parameters of the work tool 15 (Box 100: No), the control unit 20 may request input from the operator on whether to disable the control function (Box 115). If a disable order is given (Box 115: Yes), the control function may disable until shutdown (Box 120). It is understood that the control function may also be disabled instantaneously in any number of ways such as, for example, the actuation of any operator interface 40 during automatic control or the actuation of a kill switch. If disablement is not requested by the operator (Box 115: No), the control unit 20 may continue collecting data at Box 80 and calculating work tool performance footprints at Box 90.

If, however, the calculated footprint 95 is not within the desired performance or design parameter range for that work tool 15 (Box 100: Yes), the control unit 20 may send an alteration signal to components of the work machine 10 such as, for example, the hydraulic flow control devices 45 and/or the ground speed controls of the work machine 10. The alteration signal may dictate the work machine 10 modifications required to operate the work tool 15 within a desired performance or design parameter range, and may alter the work machine's operation (Box 110). The alteration signal may, for example, result in an increase or decrease in hydraulic fluid flow from the auxiliary hydraulic circuit 44 of the work machine 10 to the hydraulic components 50 of the work tool 15. The alteration signal may also result in, for example, an increase or decrease in the ground speed of the work machine 10 or a change in work tool position. As described above, the changes in hydraulic fluid flow from the auxiliary hydraulic circuit 44 to the hydraulic components 50 and/or the changes in the ground speed of the work machine 10 may be in response to the sensing of one or more operational characteristics of the work tool 15. Moreover, these changes may maintain a desired relationship or ratio between at least one of the operational characteristics of the work machine 10, and at least one of the operational characteristics of the work tool 15.

The work machine 10 may continue to operate even while the control unit 20 collects data, calculates work tool performance footprints, determines whether to alter the operation of the work machine 10, and actually alters the operation of the work machine 10. It is understood that the control unit 20 may alter the operation of the work machine 10 for work tools 15 attached to the front-end, back-end, and/or other locations or surfaces of the work machine 10. It is also understood that in some situations, the work machine 10 may not operate within its desired performance or design parameter range in order to operate the work tool 15 within its desired range.

INDUSTRIAL APPLICABILITY

According to one exemplary embodiment of the present disclosure, the work machine 10 may be a skid steer loader, the work tool 15 may be a stump grinder, and the control unit 20 may be an electronic control module ("ECM"). For ease of description, reference will be made to these particular devices performing a stump grinding application, for the remainder of the disclosure.

Before attaching the stump grinder 15 to the skid steer loader 10, the operator identifies the stump grinder 15 using a laptop computer on-board the skid steer loader 10 running service interface software. If the stump grinder 15 is a new model such that the stump grinder identification data is not already stored in the memory of the laptop computer, the operator may download the identification data to the laptop computer through any conventional means. The laptop computer sends the stump grinder identification data to the ECM 20. Based on this data, the ECM 20 selects a group of preset maps that corresponds to the particular stump grinder 15 attached to the skid steer loader 10.

Once the operator begins a stump grinding application, the operator may decide to enable the control function. To initiate the function, the operator actuates a switch 40 in the cockpit of the skid steer loader 10. Upon activation, the ECM 20 begins collecting and processing data that is continuously sent from the hydraulic fluid pressure sensors 25, work tool speed sensors 30, the hydraulic fluid flow sensors 35, and the work tool position sensors 36 located on the stump grinder 15. Although the sensors 25, 30, 35, 36 begin collecting and transmitting data as the operator begins the first grinding motion, and continue to collect the data throughout the entire work cycle, the ECM 20 only uses the data once the operator has initiated the control function.

The ECM 20 matches the data with a particular preset map from the group of preset maps already selected for the stump grinder 15. The ECM 20 then inputs the data into one or more algorithms corresponding to the particular preset map to calculate stump grinder performance footprints. Thus, the one or more algorithms correspond to the data collected for the particular stump grinder 15 attached to the skid steer loader 10 and may correspond to the stump grinding application being performed.

The ECM 20 may determine whether to alter the skid steer loader's operation based on a comparison between the calculated stump grinder performance footprints and the known design parameters or a desired performance range of the device. If the footprints are within the stump grinder's design parameters, the ECM 20 may continue to collect data and calculate footprints in a closed loop sense. For example, the ECM 20 may request operator input as to whether to disable the control function. If the operator directs the ECM 20 to continue with the control function, data collection and analysis may resume. If, on the other hand, the operator does not wish to continue, the ECM 20 may disable the control function.

If, however, a footprint falls outside of the stump grinder's design parameters, the ECM 20 will send an alteration signal to the flow control device 45 in the auxiliary circuit 44 of the skid steer loader 10 to increase, decrease, or otherwise alter the flow of hydraulic fluid to the hydraulic components 50 of the stump grinder 15. In applications where the ground speed of the work machine 10 affects work tool performance, the ECM 20 may also send an alteration signal to one or more hydro-mechanical components or controls of the work machine 10 configured to increase, decrease, or otherwise alter ground speed. These alterations may assist in accomplishing the application and will result in improved work tool performance. This improved work tool performance may improve the overall performance of the work machine 10.

For example, if the stump grinder 15 is being used to grind a large piece of particularly dense wood, the tool's rotational speed may decrease, detrimentally affecting the stump grinder's performance. In such a situation, the alteration Box described above may include increasing the flow of hydraulic fluid to the stump grinder 15, thereby increasing its rotational speed. The alteration Box may also include decreasing the ground speed of the skid steer loader 10. Alternatively, in situations where the material being ground is less dense, the alteration Box may include reducing the flow of hydraulic fluid to the stump grinder 15 and/or increasing the ground speed of the skid steer loader 10. Altering the skid steer loader's operation in this way may slow the operation of the application to prevent damage to the stump grinder 15, or may quicken the operation to reduce energy loss by the skid steer loader 10. Such alterations are based on, and may maintain, desired relationships and/or ratios between the operational characteristics of the stump grinder 15 and the operational characteristics of the skid steer loader 10. Such alterations may improve stump grinder performance during a given stump grinding application. After the alteration has been made on the skid steer loader 10, the ECM 20 will continue to alter skid steer loader operation such that the stump grinder 15 may operate within its design parameters for the duration of the application, until skid steer loader shutdown, or until the operator deactivates the process.

Other embodiments of the disclosure will be apparent to those skilled in the art from consideration of the specification and practice of the invention disclosed herein. For example, at least a portion of the control strategy 55 may be an open-loop strategy. In such an embodiment, work machine 10 operation may be altered once until the calculated work tool performance footprint is within the work tool's design parameters.

In addition, electric current, voltage, or resistance sensors may be used to collect data. The sensed current, voltage, or resistance data may be used to assist in altering the operation of the work machine. In addition, the control unit 20 may communicate with the operator by the same monitors or other operator interfaces 40 mentioned above. The work machine 10 may include a speaker or some other like device to communicate audible messages to the operator.

Moreover, the control strategy may also be used to control non-hydraulic work tools. For example, the control strategy described herein may be used to control a non-hydraulic trenching tool connected to a skid steer loader. To facilitate this control, speed and/or position sensors may be connected to a drive element of the trenching tool to collect data. The sensors may determine, for example, the effort, force, tool speed, tool position, and/or energy exerted during a given trenching application. As in the stump grinding example described above, once the operator has initiated the control function, the ECM may use the data received from the sensors to calculate a trenching tool performance footprint by inputting the data into an algorithm corresponding to the particular trenching tool. The ECM may determine whether to alter the operation of the skid steer loader based on a comparison between the calculated performance footprint and the known design parameters of that particular trenching tool. Accordingly, operation of the drive element may be modified based on these calculations.

It is intended that the specification and examples be considered as exemplary only, with the true scope of the invention being indicated by the following claims.

What is claimed is:

1. A method of operating a work machine, comprising:

sensing at least one operational characteristic of a work tool indicative of current work tool performance;

calculating at least one work tool performance footprint in response to the sensing;

comparing the at least one work tool performance footprint to a parameter range of the work tool; and altering the operation of the work machine when the calculated at least one work tool performance footprint is outside the parameter range of the work tool, to maintain a desired relationship between the at least one operational characteristic of the work tool and at least one operational characteristic of the work machine.

2. The method of claim 1, wherein altering the operation of the work machine requires an operator input.

3. The method of claim 2, wherein the operator input is a work tool identity.

4. The method of claim 2, wherein the operator input is an instruction to enable the altering of the work machine in response to the sensing.

5. The method of claim 1, further including performing at least one aspect of the altering the operation of the work machine automatically, without operator input.

6. The method of claim 1, wherein each at least one operational characteristic of the work tool is measured by a plurality of different sensors.

7. The method of claim 1, wherein altering the operation of the work machine includes modifying a flow of hydraulic fluid from the work machine to the work tool.

8. The method of claim 1, wherein altering the operation of the work machine changes the operation of the work tool.

9. The method of claim 1, further including sensing a position of the work tool.

10. The method of claim 9, wherein altering the operation of the work machine includes adjusting the position of an element of the work tool.

11. The method of claim 10, further including controlling the position of the work tool through a range of motion.

12. The method of claim 1, further including sensing multiple operational characteristics of the work tool and combining the multiple operational characteristics to form an indicator of work tool performance.

13. The method of claim 1, wherein the at least one operational characteristic of the work tool is one of work tool fluid pressure, work tool speed, or work tool fluid flow.

14. The method of claim 13, wherein the at least one operational characteristic of the work machine is one of work machine ground speed or work machine fluid flow.

* * * * *